US007216483B2

(12) United States Patent
Takeuchi

(10) Patent No.: US 7,216,483 B2
(45) Date of Patent: May 15, 2007

(54) POWER GENERATING SYSTEM UTILIZING BUOYANCY

(75) Inventor: Akio Takeuchi, Sakaki-machi (JP)

(73) Assignee: Takeuchi Mfg. Co., Ltd., Nagano (JP)

( * ) Notice: Subject to any disclaimer, the term of this patent is extended or adjusted under 35 U.S.C. 154(b) by 514 days.

(21) Appl. No.: 10/500,429

(22) PCT Filed: Nov. 10, 2003

(86) PCT No.: PCT/JP03/14285

§ 371 (c)(1),
(2), (4) Date: Jun. 28, 2004

(87) PCT Pub. No.: WO2005/045241

PCT Pub. Date: May 19, 2005

(65) Prior Publication Data

US 2006/0064975 A1 Mar. 30, 2006

(51) Int. Cl.
*F03C 1/00* (2006.01)

(52) U.S. Cl. ..... 60/495; 60/496

(58) Field of Classification Search ..... 60/495, 60/496

See application file for complete search history.

(56) References Cited

U.S. PATENT DOCUMENTS 3,715,885 A * 2/1973 Schur ..... 60/496
4,054,031 A * 10/1977 Johnson ..... 60/496
4,196,590 A * 4/1980 Fries ..... 60/496

FOREIGN PATENT DOCUMENTS

| | | |
|---|---|---|
| JP | 50-136541 A | 10/1975 |
| JP | 57-80673 | 5/1982 |
| JP | 61-33344 | 9/1986 |
| JP | 8-200205 A | 8/1996 |

* cited by examiner

*Primary Examiner*—Hoang Nguyen
(74) *Attorney, Agent, or Firm*—Dennis G. LaPointe

(57) ABSTRACT

A generating set formed so that a generator 70 connected to a rotary shaft 32 turning and supporting a conveyor 30 by utilizing the power by which a gas supplied by a supply means 60 into a bucket 50 positioned on a lower portion of the side of the conveyor 30 which is turned upward in the interior of a tower 10 is moved up with the bucket 50 in a liquid 20 stored in the interior of the tower 10 as the gas receives the buoyancy of the liquid. In this generating set, the supply means 60 is formed so as to turn compressed air into a plurality of bubbles of a very small diameter, send out these bubbles into the liquid 20 in the interior of the tower, and hold down to a low level the resistance occurring when the compressed air is sent out into the liquid 20 in the interior of the tower. An electric power energy value obtained from the generator 70 is increased with respect to a value of the energy consumed by the supply means 60.

7 Claims, 3 Drawing Sheets

POWER GENERATING SYSTEM UTILIZING BUOYANCY

TECHNICAL FIELD

This invention relates to a buoyancy-utilizing generating set adapted to rotate a generator by utilizing the buoyancy of a bubbled gas moving up in a liquid.

BACKGROUND ART

Various methods of obtaining electric power from a clean energy source harmless to the earth environment have been attempted. These methods include methods of developing, for example, a generating set utilizing wind power, a generating set utilizing wave power, and a generating set utilizing solar energy, and the like.

However, as a matter of regret, any of these related art generating sets has not come to satisfy a demand for electric power sufficiently in a modern society in which a large quantity of electric power is consumed.

The present invention has been made in view of such problems, and aims at providing a generating set adapted to rotate a generator by utilizing buoyancy occurring in a gas sent in the form of bubbles into a liquid, such as water, and capable of greatly heightening the electric power energy obtained from a generator rotated by using buoyancy occurring in a gas sent in the form of bubbles into a liquid, such as water, as compared with the consumed energy needed to send the gas in the form of bubbles into the liquid, such as water.

DISCLOSURE OF THE INVENTION

To achieve such a purpose, the buoyancy-utilizing generating set according to the invention is provided with a vertically standing cylindrical tower in which a liquid is stored, a conveyor extended vertically in the shape of a loop in the interior of the tower so that the conveyor can be vertically turned, a plurality of buckets arranged on an outer side of the conveyor at predetermined intervals in the longitudinal direction of the conveyor so that openings of the buckets face in a direction opposite to the direction in which the conveyor turns, a supply means adapted to supply a gas in the form of bubbles into a bucket positioned on a lower portion of the side of the conveyor which is moved upward in the interior of the tower, through a downwardly directed opening of the same bucket, and a generator connected to a rotary shaft supporting the conveyor rotatably.

In this arrangement, the side of the conveyor on which the bucket is provided is turned upward by utilizing the power by which the gas supplied by the supply means into the bucket positioned on a lower portion of the side of the conveyor which is turned upward in the interior of the tower is moved up with the bucket in the liquid stored in the interior of the tower as the gas receives the buoyancy of the liquid, and, with the turning of the conveyor, the generator connected to the rotary shaft which is rotated in the direction in which the conveyor is turned, and which supports the conveyor, is rotated.

The characteristics of the supply means reside in that the supply means includes a gas supply means for sending a compressed gas into the interior of a front end-closed pipe provided in a lower portion of the interior of the tower, a plurality of holes of a very small diameter adapted to turn the gas sent from the gas supply means into the interior of the pipe into a plurality of bubbles of a very small diameter and send out the bubbled gas into the liquid in the interior of the tower, and provided in a dotted manner in a circumferential wall of the pipe, and a gas introduction nozzle adapted to collect the plural bubbles of the gas sent out from the plural holes of a very small diameter in the circumferential wall of the pipe into the bucket positioned on the lower portion of the conveyor which is turned upward in the interior of the tower.

The structure of this gas supply means as compared with a gas supply means for sending the gas left in the form of large-diameter bubbles, which are supplied into the interior of the pipe, into the liquid in the interior of the tower is capable of sending smoothly with a low resistance the gas in the form of a plurality of bubbles of a very small diameter from the plural holes of a very small diameter. The plural bubbles of a very small diameter of the gas sent out from the holes of a very small diameter of the circumferential wall of the pipe into the liquid in the interior of the tower are collected reliably without omission in an inner side of the gas introduction nozzle. The resultant bubbles can be sent accurately in the form of bubbles of a large diameter, etc. from the front end of the gas introduction nozzle into the bucket positioned on the lower portion of the side of the conveyor turned in the interior of the tower in the upward direction.

Therefore, it becomes possible to heighten greatly an electric energy value obtained from the generator rotated with the rotary shaft in accordance with the rotation of the conveyor turned by the buoyancy received from the liquid stored in the interior of the tower as compared with a value of the electric power energy consumed by the gas supply means adapted to send a gas in the form of bubbles into the liquid in the interior of the tower.

In the generating set according to the invention, it is recommended that various exhaust gases having exhaust pressures, i.e. compressed gases including various exhaust gases wastefully discharged from a factory and the like into the atmospheric air, and exhaust gases wastefully discharged from internal combustion engine, such as a diesel engine and a gasoline engine and the like be used for the compressed air sent by the gas supply means into the interior of the pipe.

In such a case, these gases wastefully discharged to the atmospheric air and having an exhaust pressure can be put to practical use effectively as a generating set driving energy source.

In the generating set according to the invention, it is recommended that a flexible guide plate for sending the bubbles of a gas from the gas introduction nozzle without letting the same leak out therefrom, into the bucket positioned at a lower portion of the side of the conveyor which turns upward in the interior of the tower be provided so that the guide plate stands up from a bottom portion in the tower along an outer side surface of the same bucket.

In such a case, an intermediate portion and the like of the flexible guide plate provided so that the guide plate stands up from the inner bottom portion of the tower into the liquid in the interior thereof can be bent inward and outward at around a suitable angle in conformity with an orbit, along which the outer surface of the bucket which is positioned at a lower portion of the side of the conveyor which is turned upward in the interior of the tower, and which is turned upward with the conveyor, is moved. The inner side surface of the flexible guide plate can be constantly brought into close contact with the outer side surface of the bucket positioned on the lower portion of the side of the conveyor which is turned upward, without leaving a clearance between these two side surfaces. The flexible guide plate can prevent the some of the bubbles of a gas supplied from the gas supply means into the liquid in the interior of the tower to an upper portion of the interior of the tower from leaking to an upper portion of the interior of the tower through a space on the outer side of the bucket, which is positioned on the portion of the side of the conveyor which is turned upward in the interior of the tower, without being sent into the interior of the same bucket.

In the generating set according to the invention, it is recommended that the outer edge of the opening of each of the plural buckets arranged regularly and longitudinally along the outer side of the conveyor be provided with a sub-guide plate in a diagonally outwardly standing state so that the sub-guide plate extends in the opposite direction with respect to a trunk portion of the bucket.

In such a case, the sub-guide plate provided on the outer edge of the opening of the bucket positioned on the lower portion of the side of the conveyor which is turned upward in the interior of the tower can prevent some of the bubbles of a gas supplied from the supply means to the liquid in the interior of the tower from leaking to an upper portion of the interior of the tower through a space on the outer side of the bucket without being accurately sent into the interior of the bucket through the downwardly directed opening thereof.

In the generating set according to the invention, a predetermined quantity of liquid may be stored in the interior of the tower so that a level of an upper end of the liquid becomes equal to the height of an upper end of the conveyor.

When, in such a case, the bucket provided on the outer side of the conveyor reaches the upper end of the conveyor or a position near the upper end thereof and is directed at the opening thereof upward or substantially upward with the gas sent into the bucket discharged to the outside thereof to cause the bucket to cease receiving the buoyancy from the liquid in the interior of the tower, the bucket reaching the upper end of the conveyor or a position near the end thereof can be exposed from the interior of the liquid of a high fluid resistance in the tower to the atmospheric air of a low fluid resistance. The bucket reaching the upper end of the conveyor or a position near the upper end thereof can be turned with the conveyor smoothly on the outer side thereof with a low resistance. A value of the fluid resistance exerted on the bucket turned with the conveyor can be lowered.

In the generating set according to the invention, the conveyor may be formed by a combination of a chain and sprockets.

In such a case, the conveyor formed by a combination of a chain and sprockets can be turned in the liquid in the interior of the tower accurately in the vertical direction without causing the conveyor to slip. In accordance with the turning of the chain, rotary shafts of the sprockets supporting the chain can be turned reliably in the direction in which the chain is turned. The generator connected to the rotary shaft can be turned reliably in the chain turning direction. During this time, the chain can be turned smoothly with a low engagement resistance around the sprockets by using as a lubricant the liquid stored in the interior of the tower.

BEST MODE FOR CARRYING OUT THE INVENTION

The best mode for carrying out the invention will now be described with reference to the drawings.

Figure 1:
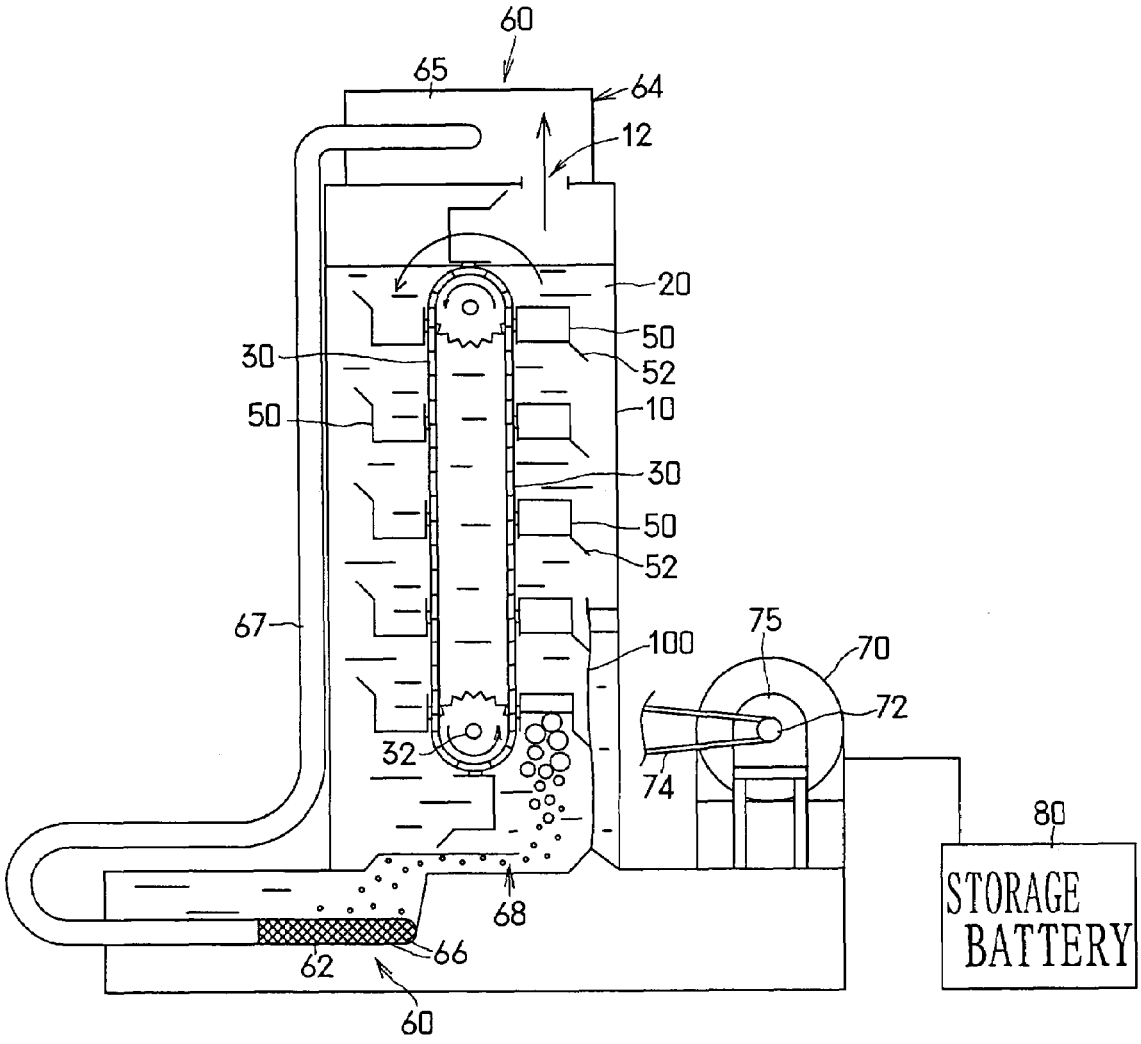
FIG. 1 is a front sectional view showing the general construction of the generating set according to the invention, FIG. 2 a front view of the generating set according to the invention.
Figure 2:
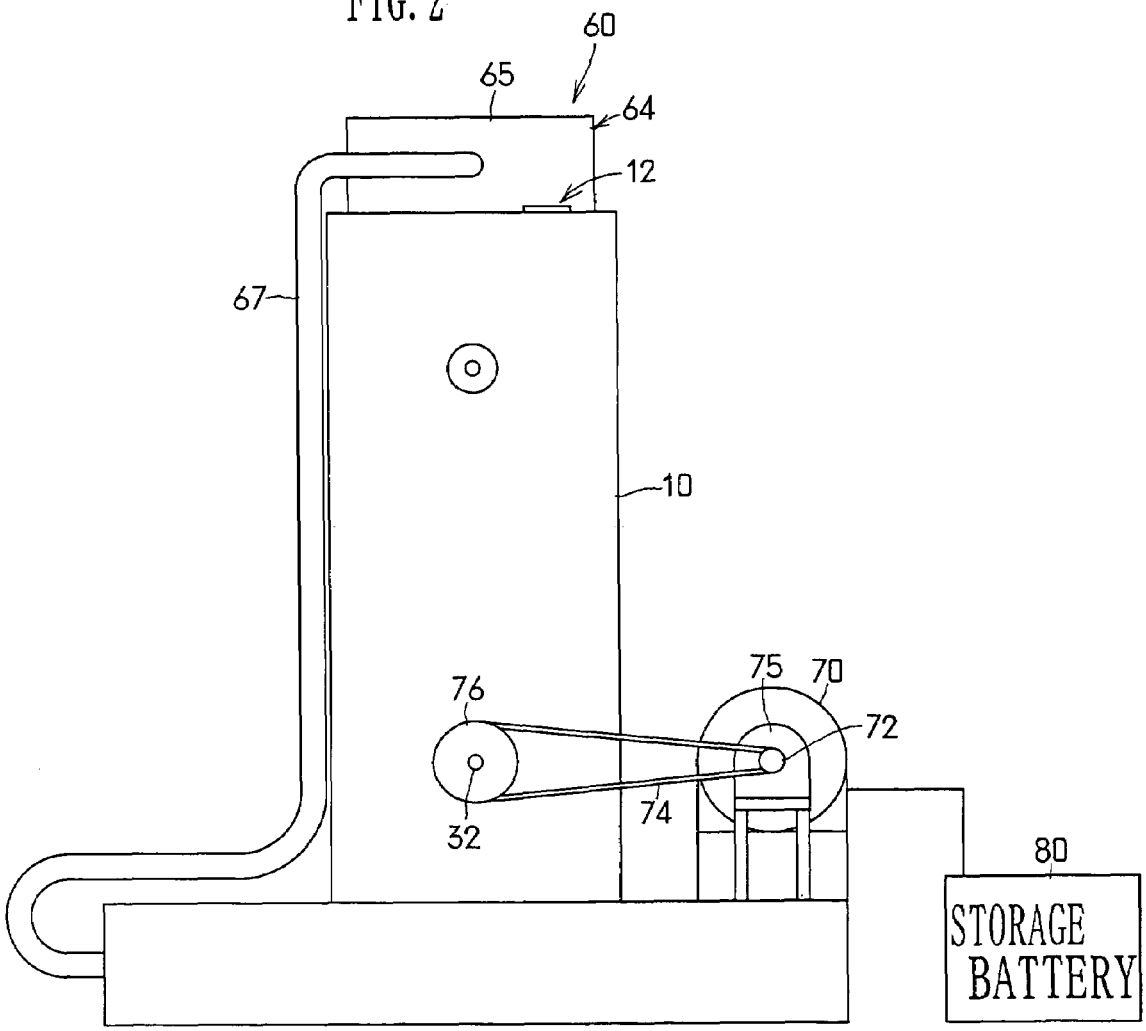
Figure 3:
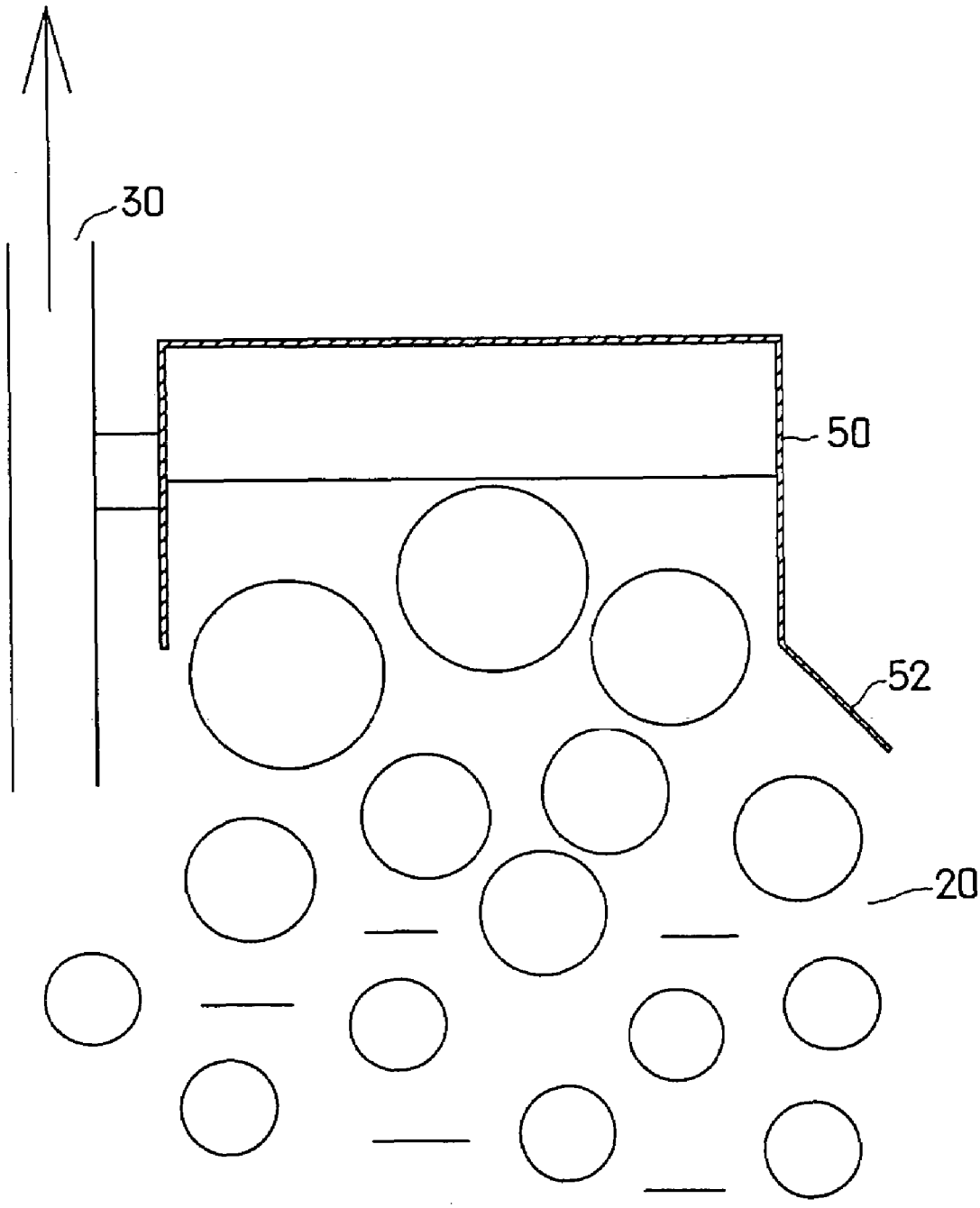
FIG. 3 is an enlarged construction diagram of a portion around the buckets of the generating set according to the invention.

FIG. 1 to FIG. 3 show a preferred embodiment of the generating set according to the invention.

This generating set is provided with a vertically standing cylindrical tower 10 in which a liquid 20 is stored. The tower 10 is provided at an upper end thereof with a gas discharge hole 12 adapted to let a gas rising in a liquid 20 in the interior of the tower 10 and reaching the upper end of the interior of the tower 10 escape therefrom to the outside thereof. In the interior of the tower, a conveyor 30 extending vertically, immersed in the liquid 20 and having the shape of a loop is rotatably provided. Along longitudinal outer sides of the conveyor 30, a plurality of buckets 50 are arranged at predetermined intervals and fixed thereto. The buckets 50 have the shape of a cubic box opened widely at upper ends thereof, and arranged plurally along the outer side of the conveyor 30 in the longitudinal direction thereof and fixed thereto with the openings of the buckets facing in the direction opposite to the direction in which the conveyor 30 is turned. A supply means 60 for supplying bubbles of a gas into a bucket 50 through the downwardly directed opening thereof, which bucket 50 is positioned on a lower portion of the side of the conveyor which extends between an outer portion of the tower 10 and a lower portion of the interior of the tower 10 of the conveyor 30 which is turned upward in the interior of the tower 10. A driving shaft 72 of a generator provided outside the tower 10 is connected to a lower rotary shaft 32, on which the conveyor 30 is rotatably supported, via a chain 74 and a sprocket 76.

The gas supplied by the supply means 60 into the bucket 50 positioned on a lower portion of the side of the conveyor 30 which is turned upward in the interior of the tower 10 moves up with the bucket 50 in the liquid 20 stored in the interior of the tower 10 as the gas receives buoyancy. The side of the conveyor 30 on which the bucket 50 is provided is turned upward with this bucket lifting force utilized. With this turning of the conveyor 30, the generator 70 connected to the lower rotary shaft 32 supporting the conveyor 30 and rotating in the direction in which the conveyor 30 is turned.

The supply means 60 includes a gas supply means 64 for sending a compressed gas into the interior of the front end-closed pipe 62 provided in a lower portion of the interior of the tower 10, a plurality of holes 66 of a very small diameters provided in a dotted manner in a circumferential wall of the pipe 62 for sending out a gas, which is supplied to the interior of the pipe 62 by the gas supply means, in the form of a plurality of bubbles of a very small diameter into the liquid 20 in the interior of the tower, and a gas introduction nozzle 68 for collecting a plurality of bubbles of a gas sent out from the plural holes 66 of a very small diameter of the circumferential wall of the pipe into the liquid 20 in the interior of the tower, and sending out the collected bubbles of a gas into the interior of a bucket 50, which is positioned on the lower portion of the side of the conveyor which is turned upward in the interior of the tower 10, through a downwardly directed opening of the bucket 50. The gas supply means 64 includes an air compressor 65 mounted on the outer side of the upper end of the tower 10 and adapted to send out compressed air, and an air circuit 67 for sending out the compressed air, which is sent out from the air compressor, into the interior of the front end-closed pipe 62 provided in the lower portion of the interior of the tower 10. A porous pipe having holes of around several microns to several hundred microns at a substantially uniform density in a circumferential wall thereof similar to the porous pipe disclosed in, for example, JP-UM-B-61-33344 is used for the pipe 62 having a plurality of holes 66 of a very small diameter in the circumferential wall thereof provided for sending out compressed air in the form of bubbles of a very small diameter into the liquid 20 in the interior of the tower. The compressed air sent by the gas supply means 64 into the interior of the pipe 62 can be sent out in the form of a plurality of bubbles of a very small diameter from the holes 66 of a very small diameter provided in a dotted manner in the circumferential wall of the pipe 62 into the liquid 20 in the interior of the tower smoothly with a low resistance.

The gas introduction nozzle 68 is formed so that a rear portion thereof covers continuously without any clearance a circumference of the pipe 62 having a plurality of holes 66 of a very small diameter, and a front end of the gas introduction nozzle is disposed just under the bucket 50 positioned on a lower portion of the side of the conveyor 30 which is turned upward in the interior of the tower 10. The gas introduction nozzle is capable of reliably collecting in the interior of the gas introduction nozzle 68 without omission the compressed air in the form of a plurality of bubbles of a very small diameter sent out from the plural holes 66 of a very small diameter of the circumferential wall of the pipe into the liquid 20 in the interior of the tower, and sending accurately the resultant compressed air in the form of bubbles of a large diameter into the bucket 50 positioned in the lower portion of the side of the conveyor 30 which is turned upward in the interior of the tower 10 from the downwardly directed opening of the bucket.

The generating set shown in FIG. 1 to FIG. 3 is formed in the above-described manner. To use this generating set practically, the air compressor 65 of the air supply means is operated, and the compressed air is thereby sent into the interior of the pipe 62 provided at a lower portion of the interior of the tower 10, through the air circuit 67 as shown in FIG. 1. The compressed air is sent out from the holes 66 of a very small diameter provided in a dotted manner in the circumferential wall of the pipe 62, formed into plural bubbles of a very small diameter, and sent into the liquid 20 in the interior of the tower with a low resistance. The compressed air sent out in the form of a plurality of bubbles of a very small diameter into the liquid 20 in the interior of the tower is collected reliably without omission in the interior of the gas introduction nozzle 68 as shown in FIG. 3. The collected compressed air is then sent in the form of bubbles of a large diameter from the downwardly directed opening of the bucket 50 thereinto which is positioned on the lower portion of the side of the conveyor 30 which is turned upward in the interior of the tower 10.

As a result, the compressed air supplied into the interior of the bucket 50 moves up with the bucket 50 in the liquid 20 stored in the interior of the tower 10 as the compressed air receives buoyancy from the liquid. The side of the conveyor 30 to which the bucket 50 is fixed can be turned upward with the compressed air and bucket lifting force utilized. With the turning of the conveyor 30, a driving shaft 72 of a generator connected to the lower rotary shaft 32 rotating in the direction in which the conveyor 30 is turned and supporting the conveyor 30 can be turned. Thus, electric power can be generated in the generator 70. The electric power generated in the generator 70 can be stored in, for example, a capacitor 80.

In this generating set, the gas supply means 64 may be formed to a structure for sending gases having an exhaust pressure, such as various kinds of exhaust gases wastefully discharged from a factory into the atmospheric air, and exhaust gases wastefully discharged from an internal combustion engine, such as a diesel engine and a gasoline engine into the interior of the pipe 62 instead of a structure for sending the compressed air generated in the air compressor 65 into the interior of the pipe 62. The gas supply means 64 may also be formed to a structure for sending the compressed air generated in the air compressor 65 into the interior of the pipe 62 while sending an exhaust gas having an exhaust pressure, such as various kinds of exhaust gases wastefully discharged from a factory into the atmospheric air, and exhaust gases wastefully discharged from an internal combustion engine, such as a diesel engine and a gasoline engine into the interior of the pipe 62.

In such a case, various kinds of discharge gases and exhaust gases having an exhaust pressure, i.e. compressed gases wastefully sent out from a factory and internal combustion engines into the atmospheric air can be utilized effectively as generating set driving energy sources.

In this generating set, it is recommended as shown in FIG. 1 that a flexible belt type guide plate 100 of a synthetic resin and the like for sending without omission the bubbled gas from the front end of the gas introduction nozzle 68 into the interior of the bucket 50 positioned on the lower portion of the side of the conveyor 30 which is turned upward in the interior of the tower 10 be provided in the liquid 20 in the interior of the tower so that the guide plate stands along the outer surface of the bucket 50 positioned on the lower portion of the side of the conveyor 30 which is turned upward in the interior of the tower 10.

In such a case, an intermediate portion and the like of the flexible guide plate 100 provided so that the guide plate stands up from the inner bottom portion of the tower 10 into the liquid 20 in the interior thereof as shown in FIG. 1 can be bent inward and outward at around a suitable angle in conformity with an orbit, along which an outer surface of the bucket 50, which is positioned on a lower portion of the side of the conveyor 30 which is turned upward in the interior of the tower 10, and which is turned upward with the conveyor 30, is moved. The inner side surface of the flexible guide plate 100 can be constantly brought into close contact with the outer side surface of the bucket 50 positioned on the lower portion of the conveyor turned upward, without leaving a clearance between these two side surfaces, in such a manner that the guide plate 100 does not hamper the movement of the bucket 50 which is turned with the conveyor 30. The flexible guide plate 100 can prevent the some of the bubbles of a gas supplied from the gas supply means 60 into the liquid 20 in the interior of the tower 10 to an upper portion of the interior of the tower from leaking to an upper portion of the interior of the tower 10 through a space on the outer side of the bucket 50, which is positioned on the portion of the side of the conveyor 30 which is turned upward in the interior of the tower 10, without being sent into the interior of the same bucket 50.

In this generating set, it is recommended that, as shown in FIG. 1, the outer edge of the opening of each of the plural buckets 50 arranged regularly and longitudinally along the outer side of the conveyor 30 be provided with a sub-guide plate 52 of a shape of a belt and the like in a diagonally outwardly standing state so that the sub-guide 52 extends in the opposite direction with respect to a trunk portion of the bucket 50.

In such a case, the sub-guide plate 52 provided on the outer edge of the opening of the bucket 50 positioned on the lower portion of the conveyor 30 turned upward in the interior of the tower 10 can prevent some of the bubbles of a gas supplied from the supply means 60 to the liquid 20 in the interior of the tower 10 from leaking to an upper portion of the interior of the tower through a space on the outer side of the bucket 50 without being accurately sent into the interior of the bucket 50 through the downwardly directed opening thereof.

In this generating set, a predetermined quantity of liquid 20 may be stored as shown in FIG. 1, in the interior of the tower 10 so that a level of an upper end of the liquid 20 stored in the interior of the tower 10 becomes equal to the height of an upper end of the conveyor 30.

When, in such a case, the bucket 50 provided on the outer side of the conveyor 30 reaches the upper end of the conveyor 30 or a position near the upper end thereof and is directed at the opening thereof upward or substantially upward with the compressed air sent into the bucket 50 discharged to the outside thereof to cause the bucket 50 to cease receiving the buoyancy from the liquid 20 in the interior of the tower, the bucket 50 reaching the upper end of the conveyor 30 or a position near the end thereof can be exposed from the interior of the liquid 20 of a high fluid resistance in the tower 10 to the atmospheric air of a low fluid resistance. The bucket 50 reaching the upper end of the conveyor 30 or a position near the upper end thereof can be turned with the conveyor 30 smoothly with a low resistance on the outer side of the conveyor 30. A value of the fluid resistance exerted on the bucket 50 circulated with the conveyor 30 can be lowered.

In this generating set, the conveyor 30 may be formed by a combination of a chain and sprockets as shown in FIG. 1.

In such a case, the conveyor 30 formed by a combination of a chain and sprockets can be turned in the liquid 20 in the interior of the tower accurately in the vertical direction without causing the conveyor to slip. In accordance with the turning of the chain, rotary shafts 32 of the sprockets supporting the chain can be turned reliably in the direction in which the chain is turned. Thereby, the generator 70 connected to the rotary shaft 32 can be run in the direction in which the chain is turned. During this time, the chain can be turned smoothly with a low engagement resistance around the sprockets by using as a lubricant the liquid 20 stored in the interior of the tower.

According to the results of an experiment, the following have been ascertained.

When electric power is generated in a generator 70 by using the same generating set as is shown in FIG. 1 to FIG. 3, the bubbled compressed air sent into a bucket 50 is lifted with the bucket 50 in a liquid 20 stored in the interior of the tower 10 as the bubbled compressed air receives buoyancy from the liquid. It was proven that a value of the energy of output electric power obtained by utilizing this lifting force from a generator 70 rotated in the turning direction of the conveyor 30 could be heightened greatly as compared with that of the energy of electric power consumed by a supply means 60 adapted to send the compressed air in the form of bubbles into the liquid 20 in the interior of the tower.

This experiment will now be described in detail below.

In this experiment, two compressors of specific power consumption of 100 W were used for an air compressor 65. In the interior of the tower 10, city water was stored. Two outer rotor generators of P-500G manufactured by the Power Z Co., Ltd. were used in a connected state for the generator 70. These two generators 70 were rotated by utilizing the buoyancy which the bubbled compressed air sent from the two 100 W compressors into the city water stored in the interior of the tower 10 received from the city water. A speed increasing gear 75 made of a combination of a plurality of gears was mounted on a driving shaft 72 of the generator, and the generator 70 was rotated at a high speed of substantially 1000 rpm.

As a result, the output voltage value of each of the two generators 70 became 50,000 V, and the output current value of each thereof 3,050 A. Namely, the output power value of each of the two generators 70 became 152,500 W. The results proved that the specific power consumption value of the air compressor 65 of the feed means was 200 W with the output power value, which was obtained from the two generators 70, having become 305,000 W, and that the output power value of the generators 70 with respect to the specific power consumption value of the supply means 60 increased greatly, i.e., about 1.5 times.

A liquid having specific gravity higher than that of the water and enabling a gas sent thereinto to receive a high buoyancy and a liquid rarely corroded even when the liquid continues to be stored for a long period of time can be used for the liquid 20 stored in the tower 10 of the generating set according to the invention. Various kinds of gases other than the air can be used for the gas sent into the liquid 20 in the interior of the tower.

INDUSTRIAL APPLICABILITY

The generating set according to the invention can be utilized widely as a power supply source harmless to the earth environment and constituting measures to save energy in a factory and the like in which a large quantity of electric power is consumed, and as an energy-saving power supply source for a general household.

The invention claimed is:

1. A buoyancy-utilizing generating set provided with a vertically standing cylindrical tower in which a liquid is stored, a conveyor extended vertically in the shape of a loop in the interior of the tower so that the conveyor can be vertically turned, a plurality of buckets arranged on an outer side of the conveyor at predetermined intervals in the longitudinal direction of the conveyor so that openings of the buckets face in a direction opposite to the direction in which the conveyor turns, a supply means adapted to supply a gas in the form of bubbles into a bucket positioned on a portion of the side of the conveyor which is turned upward in the interior of the tower, through a downwardly directed opening of the same bucket, and a generator connected to a rotary shaft supporting the conveyor rotatably, the side of the conveyor on which the bucket is provided being turned upward by utilizing the power by which the gas supplied by the supply means into the bucket positioned on the lower portion of the side of the conveyor which is turned upward in the interior of the tower is moved up with the bucket in the liquid stored in the interior of the tower as the gas receives the buoyancy of the liquid, the generator connected to the rotary shaft rotated in the turning direction of the conveyor being rotated in accordance with the turning of the conveyor, wherein:

the supply means includes a gas supply means for sending a compressed gas into an interior of a front end-closed pipe provided in a lower portion of the interior of the tower, a plurality of holes, said holes having an opening of about several microns to several hundred microns and said holes being located at a substantially uniform density in a circumferential wall of said front-end closed pipe adapted to turn the gas sent from the gas supply means into the interior of the pipe into a plurality of uniform micron-sized bubbles and send out the bubbled gas into the liquid in the interior of the tower, a gas introduction nozzle adapted to collect the plurality of uniform micron-sized bubbles of the gas sent out from the plurality of holes in the circumferential wall of the pipe into the bucket positioned on the lower portion of the side of the conveyor which is turned upward in the interior of the tower, and means for directing the plurality of uniform micron-sized bubbles into the bucket position in a lower portion of the side of the conveyor without causing leakage of the bubbled gas around an exterior of said bucket.

2. A buoyancy-utilizing generating set according to claim 1, wherein a gas discharged to the atmospheric air and having an exhaust pressure is used as the compressed gas sent by the gas supply means into the interior of the pipe.

3. A buoyancy-utilizing generating set according to claim 1, wherein said means for directing the plurality of uniform micron-sized bubbles into the bucket position in a lower portion of the side of the conveyor without causing leakage of the bubbled gas around the exterior of said bucket comprises:

a flexible guide plate for sending the bubbled gas from the gas introduction nozzle into the bucket positioned in said lower portion of the side of the conveyor which is turned upward in the interior of the tower without causing the leakage of the bubbled gas to occur, wherein the guide plate stands up from a bottom portion of the tower into the liquid in the interior of the tower and extends along the outer side surface of the bucket positioned on a lower portion on the side of the conveyor which is turned upward in the interior of the tower.

4. A buoyancy-utilizing generating set according to claim 1, further comprising:

a sub-guide plate provided on an outer side edge of an opening of each of the plurality of buckets arranged side by side in the longitudinal direction on an outer side of the conveyor so that the sub-guide plate stands up in the diagonally outward direction which is opposite to a trunk portion side of the bucket.

5. A buoyancy-utilizing generating set according to claim 1, wherein a predetermined quantity of liquid is stored in the interior of the tower so that the level of an upper end of the liquid becomes substantially equal to the height of an upper end of the conveyor.

6. A buoyancy-utilizing generating set according to claim 1, wherein the conveyor is made of a combination of a chain and sprockets.

7. A buoyancy-utilizing generating set according to claim 3, further comprising:

a sub-guide plate provided on an outer side edge of an opening of each of the plurality of buckets arranged side by side in the longitudinal direction on an outer side of the conveyor so that the sub-guide plate stands up in the diagonally outward direction which is opposite to a trunk portion side of the bucket.

* * * * *